US011598170B1

(12) United States Patent
Alsaleh

(10) Patent No.: US 11,598,170 B1
(45) Date of Patent: Mar. 7, 2023

(54) METHODS AND SYSTEMS TO RETRIEVE A WIRELINE/ELINE IN A WELLBORE WITH A COILED TUBING

(71) Applicant: SAUDI ARABIAN OIL COMPANY, Dhahran (SA)

(72) Inventor: Mohammad W. Alsaleh, Mubarraz (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/454,575

(22) Filed: Nov. 11, 2021

(51) Int. Cl.
*E21B 31/00* (2006.01)
*E21B 29/04* (2006.01)

(52) U.S. Cl.
CPC ..... *E21B 31/00* (2013.01); *E21B 29/04* (2013.01)

(58) Field of Classification Search
CPC ..... E21B 31/00; E21B 31/16; E21B 29/04; E21B 33/068
See application file for complete search history.

(56) References Cited

U.S. PATENT DOCUMENTS 5,477,921 A * 12/1995 Tollefsen ..... G01V 13/00 166/301
6,805,197 B2 10/2004 Brumley et al.
2007/0284113 A1* 12/2007 Haheim ..... E21B 33/068 166/345
2021/0340832 A1* 11/2021 Almalki ..... E21B 29/04

OTHER PUBLICATIONS

Hillier, Jill et al., "Unique Electronically Activated Nonexplosive Wireline Cutter Provides Safe and Reliable Cuts on Largest Range of Slickline and Wireline Cables"; Proceedings of the SPE/ICoTA Well Intervention Conference and Exhibition; Paper No. SPE-199800-MS; pp. 1-6; Mar. 16, 2020 (6 pages).

* cited by examiner

*Primary Examiner* — Giovanna Wright
(74) *Attorney, Agent, or Firm* — Osha Bergman Watanabe & Burton LLP

(57) ABSTRACT

A fishing operation may include actuating a blind ram above the wellhead to seal around the wireline; pulling out a portion of the wireline out of the wellhead; cutting the portion of the wireline; rigging up a coiled tubing blowout preventer on top of the blind ram; connecting a wire within a coiled tubing to the wireline; connecting a coiled tubing bottom hole assembly to the coiled tubing; opening the blind ram and running in hole the coiled tubing into the wellbore; pulling, with the wire, the wireline inside the coiled tubing as the coiled tubing is lowered into the wellbore; lowering the coiled tubing to reach a depth within the wellbore containing a stall or stuck point in the tubular string; cutting the wireline with a wire cutter of the coiled tubing bottom hole assembly; and pulling out the coiled tubing with the wireline.

20 Claims, 10 Drawing Sheets

METHODS AND SYSTEMS TO RETRIEVE A WIRELINE/ELINE IN A WELLBORE WITH A COILED TUBING

BACKGROUND

In the oil and gas industry, operations may be performed in a wellbore at various depths below the surface. In order to recover hydrocarbons from a well, any number of electrical systems may be deployed for providing power within the wellbore to perform various operations. Many of these electrical systems need high-reliability power grids and power control units located on the surface or rig to power various devices. Power systems play a major role in providing the required and reliable power to the various electrical systems. In conventional methods, power is provided from external sources to the downhole tools via cables to submerged process control equipment, pumps and compressors, transformers, motors, and other electrically operated equipment. For example, the cable may be a wireline. The wireline is an electrical cable used to lower tools into and transmit data about the conditions of the wellbore. The wireline may consist of braided cables and be used to perform wireline logging, as well. Wireline logging is the acquisition and analysis of geophysical and petrophysical data and the provision of related services provided as a function of along-hole depth. In addition to the wireline or separate of the wireline, a slickline may be run in the wellbore. The slickline is a nonelectric cable used for setting and retrieving wellbore tools, such as a plug.

In oil and gas, downhole tools may be become stuck during drilling and workover operations, even when preventive measures are taken. Fishing operations are conducted for removing lost, stalled, or stuck tubulars and downhole tools from the wellbore. Fishing operations fall into three categories: open hole, when there is no casing in the area of the fish; cased hole, when the fish is inside casing; or thru-tubing, when it is necessary to fish through the restriction of a smaller pipe size (tubing). Fishing operations may be expensive, time-consuming, and require special tools. One of the most challenging of all fishing operations is the recovery of wireline or slickline and the tool or instruments run with the wireline or slickline. Conventional methods cut only a part of the wireline and leave the remainder of the wireline within the wellbore, thereby requiring further fishing operations.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, the embodiments disclosed herein relate to a method for conducting a fishing operation on a wellbore having a tubular string therein with a wireline extending into the wellbore from a wellhead. The method may include: actuating a blind ram above the wellhead to seal around the wireline; pulling out a portion of the wireline out of the wellhead; cutting the portion of the wireline; rigging up a coiled tubing blowout preventer on top of the blind ram; connecting a wire within a coiled tubing to the wireline; connecting a coiled tubing bottom hole assembly to the coiled tubing; opening the blind ram and running in hole the coiled tubing into the wellbore; pulling, with the wire, the wireline inside the coiled tubing as the coiled tubing is lowered into the wellbore; lowering the coiled tubing to reach a depth within the wellbore containing a stall or stuck point in the tubular string; cutting the wireline with a wire cutter of the coiled tubing bottom hole assembly; and pulling out the coiled tubing with the wireline.

In another aspect, the embodiments disclosed herein relate to a system. The system may include: a wellhead on a surface of a wellbore; a tubing string disposed within the wellbore; a wireline extending downward into the wellbore from the wellhead; a wireline blind ram disposed on top of the wellhead; a coiled tubing blowout preventer disposed on top of the wireline blind ram; and a modified coiled tubing spooled on the surface. The modified coiled tubing may include a coiled tubing spooled on a first spool reel; a wire spooled on a second spool reel, the wire is inserted in one end of the coiled tubing; and a coiled tubing bottom hole assembly connected to an opposite end of the coiled tubing, coiled tubing bottom hole assembly includes a wire cutter configured to the cut the wireline and a downhole stripper configured to seal around the coiled tubing. The wire is connected to the wireline and configured to pull the wireline when the coiled tubing is run in the wellbore.

In yet another aspect, the embodiments disclosed herein relate to a method for conducting a fishing operation on a wellbore having a tubular string therein with a wireline extending into the wellbore from a wellhead. The method may include: shutting off the wellbore from further downhole operations; actuating a wireline blind ram to close and seal around the wireline; rolling out a portion of the wireline out of the wellhead; cutting the portion of the wireline at a surface; rigging up a coiled tubing blowout preventer on top of the wireline blind ram; replacing a wireline unit at the surface with a coiled tubing unit; connecting a wire of the coiled tubing unit to the wireline, the wire travels through a coiled tubing of the coiled tubing unit; retracting a blind ram and of the wireline blind ram and running in hole the coiled tubing into the wellbore; pulling, with the wire, the wireline inside the coiled tubing as the coiled tubing is lowered into the wellbore; lowering the coiled tubing to reach a depth within the wellbore containing a stall or stuck point in the tubular string; actuating a wire cutter of a coiled tubing bottom hole assembly attached to a lowermost end of the coiled tubing; and pulling out the coiled tubing with the wireline out of the wellbore.

Other aspects and advantages will be apparent from the following description and the appended claims.

BRIEF DESCRIPTION OF DRAWINGS

Embodiments of the present disclosure will now be described in detail with reference to the accompanying Figures. Like elements in the various figures may be denoted by like reference numerals for consistency.

DETAILED DESCRIPTION

Figure 1:
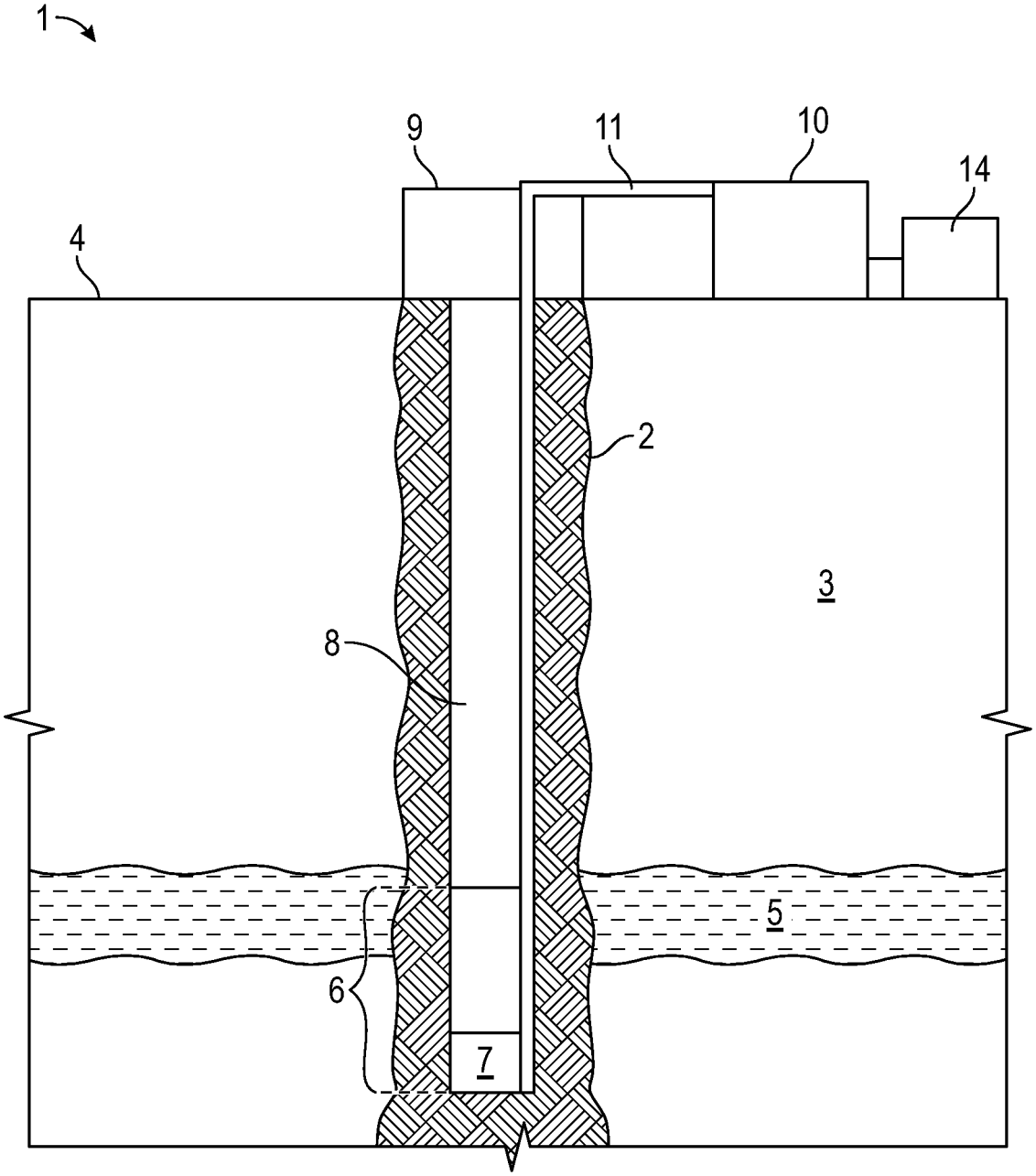
FIG. 1 shows a well system in accordance with one or more embodiments.

In the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

As used herein, the term "coupled" or "coupled to" or "connected" or "connected to" "attached" or "attached to" may indicate establishing either a direct or indirect connection, and is not limited to either unless expressly referenced as such. Wherever possible, like or identical reference numerals are used in the figures to identify common or the same elements. The figures are not necessarily to scale and certain features and certain views of the figures may be shown exaggerated in scale for purposes of clarification. In addition, any terms designating tubular (i.e., a length of pipe that provides a conduit through which oil and/or gas may be produced) should not be deemed to limit the scope of the disclosure. The tubular may be connected to other tubulars to from a tubular string. As used herein, fluids may refer to slurries, liquids, gases, and/or mixtures thereof. The embodiments are described merely as examples of useful applications, which are not limited to any specific details of the embodiments herein.

Embodiments disclosed herein relate generally to fishing operations in oil and gas well sites. More specifically, embodiments disclosed herein relate to systems and methods for using a coiled tubing for retrieving a cable (e.g., wireline) during a fishing operation. In one aspect, embodiments disclosed herein relate to cutting the cable at a fish neck and avoid leaving fishing tools in the wellbore.

According to embodiments of the present disclosure, the coiled tubing is a continuous length of small-diameter steel pipe with a conduit. In a non-limiting example, the coiled tubing may have a diameter of 0.75 to 4.5 inches and have a continuous length to reach any depth in the wellbore. The continuous length can range from 2,000 ft to 15,000 ft (610 to 4,570 m) or greater length. The coiled tubing may be wound on a spool reel. The coiled tubing is straightened prior to entering a wellbore and rewound to coil the coiled tubing back onto the spool reel. Additionally, a wire is pumped in the conduit of the coiled tubing to form a modified coiled tubing. The wire is wound on a separate spool reel designed to insert the wire into an end of the coiled tubing at the surface. Further, the wire may connect to the cable within the wellbore. In some embodiments, the separate spool reel may include a speedometer and a tension sensor in order to keep the cable in the wellbore under tension and allow the coiled tubing to be run in hole to the fish neck and eliminate the risk of cutting the cable. In some embodiments, the speedometer is incorporated into a depth encoder to use depth and time measurements to determine a speed of the cable. Further, an end of the wire may include a connection tool to connect to the cable. The connection tool may be a bolt nut or rope socket tool. In some embodiments, the coiled tubing includes a coiled tubing bottom hole assembly (BHA). The coiled tubing BHA includes at least includes a wire cutter and a downhole stripper. The coiled tubing BHA is attached to an end of the coiled tube that will reach the furthest depth in a wellbore.

FIG. 1 shows a block diagram of a system in accordance with one or more embodiments. FIG. 1 shows a well site 1 according to one or more embodiments. A wellbore 2 may be located in the earth 3 having a surface 4. The wellbore 2 may be drilled from the surface 4 to a production zone 5 which contains hydrocarbons. To drill the wellbore 2, a drill bit 7 of a bottom hole assembly (BHA) 6 may be lowered down and drill through the earth 3 to form the wellbore 2. The BHA 6 may be attached a tubular string 8 extending downward from a wellhead 9 at the surface 4. the BHA 6 may include further components such as drill collars, mud motors, stabilizers, logging while drilling (LWD) tools, measurement while drilling (MWD) tools, and various other downhole tools without departing from the scope of the present disclosure. The tubular string 8 may include various tubulars and downhole tools made up together to form a continuous tubular string, such as a drill string. Additionally, a cable unit 10 may be provided on the surface 4 to employ a cable 11 into the wellbore 2 via the wellhead 9. The cable 11 may be a wireline, slickline, or electric line running from the cable unit 10 through the wellhead 9 and connect down to the BHA 6. The cable 11 may be a multi-conductor, single conductor, braided, or fiber optic cables as a conveyance for the acquisition of subsurface data for a computer system 14 coupled, wireless or wired, to the cable unit 10 to analysis for subsurface geology, reservoir properties and production characteristics.

The well site 1 of FIG. 1 may be used in various stages of a well, such as rig site preparation, drilling, completion, abandonment etc., and in other environments, such as workover rigs, fracking installation, well-testing installation, oil and gas production installation, without departing from the scope of the present disclosure. For example, when running in hole (RIH), the tubular string 8 and the BHA 6 are lowered into the wellbore 2 in a controlled fashion. Additionally, when pulling out of the hole (POOH), the tubular string 8 and the BHA 6 are removed out of the wellbore 2. In both RIH and POOH, the tubular string 8 and the BHA 6 may get stick or stall or even get lost downhole during operations. In such an event, non-productive time (NPT) may increase in addition to possible equipment damage, hazardous work environment, and total well lose. To decrease or prevent NPT, equipment damage, hazardous work environment, and total well lose, a fishing operation as described in the flowchart of FIG. 2 and the system of FIGS. 3-9 may be performed. The fishing operation as described in the flowchart of FIG. 2 and the system of FIGS. 3-9 may result in not leaving tools in the wellbore 2 which will return the well back online faster and the cost of the ongoing fishing procedure will be eliminated.

Figure 2:
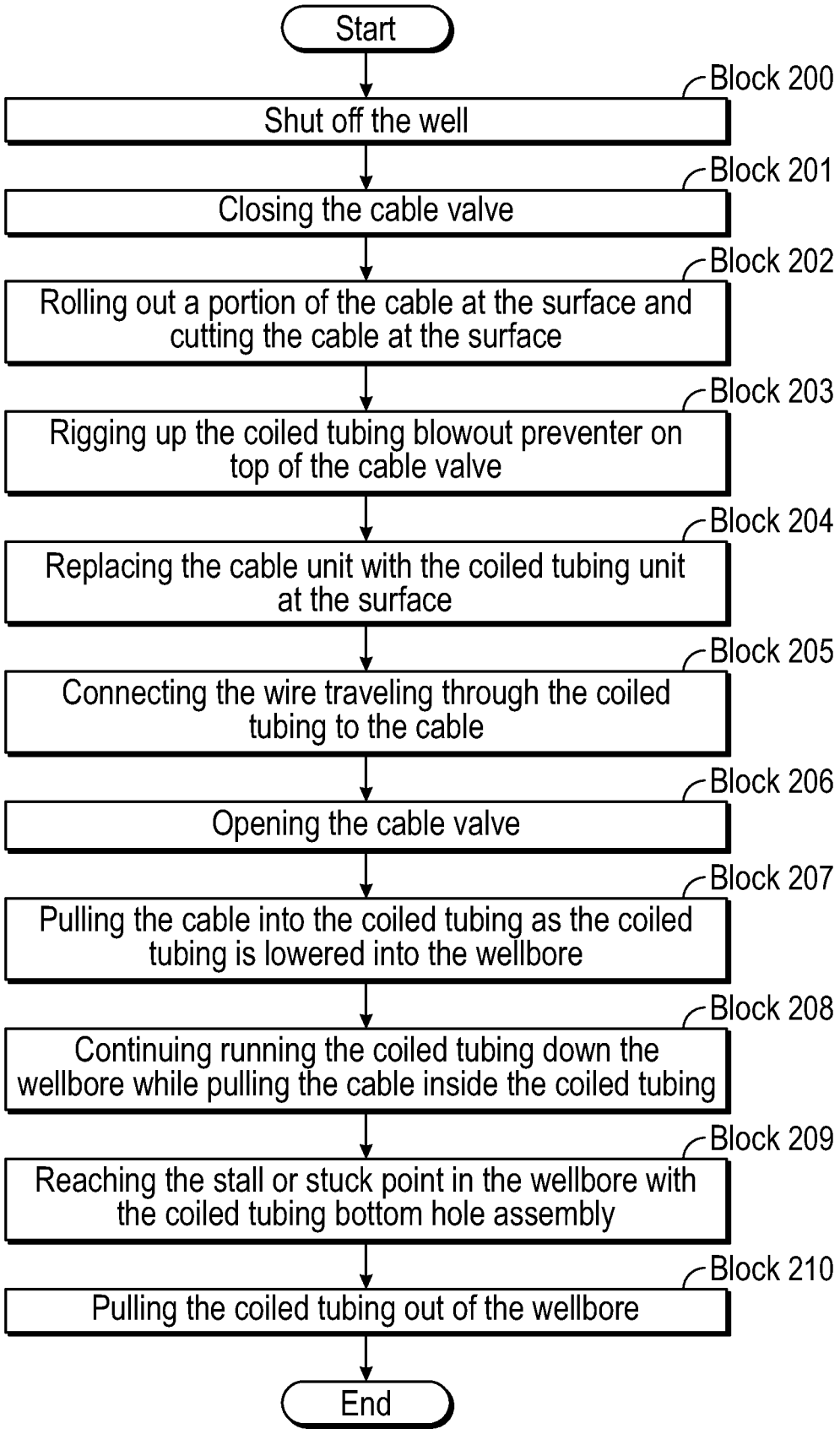
FIG. 2 shows a flowchart in accordance with one or more embodiments.

FIG. 2 is a flowchart showing a method of a fishing operation preformed on the well site 1 of FIG. 1. One or more blocks in FIG. 1 may be performed by one or more components (e.g., a computing system coupled to a controller in communication with the devices at the well site 1). For example, a non-transitory computer readable medium may store instructions on a memory coupled to a processor such that the instructions include functionality for conducting the fishing operation. While the various blocks in FIG. 2 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 200, the well is shut off stopping production or drillings operations, i.e., the well is killed. For example, operations being conducted in the wellbore are stopped and the wellhead may be used to control downhole pressure and fluids. In Block 201, with the well shut off, the cable valve is closed to seal around the cable within the wellbore. For example, blind rams of the cable valve are actuated to extend into a bore to close and seal around the cable. In Block 202, a portion of the cable is rolled out (as needed) of the cable valve above the wellhead and cut at the surface. For example, a cable unit at the surface pulls the cable through the cable valve until a length of the cable is extended out of the wellhead. Then, a cutting tool is used to cut the length of the cable at the surface. Additionally, the cable valve holds the remainder of the cable within the wellbore in tension.

In Block 203, the coiled tubing blowout preventer is rigged up on top of the cable valve. For example, the coiled tubing blowout preventer is lifted from a side of the wellhead at which the cable is coming out and placed on top of the cable valve. Additionally, the cable is run through the coiled tubing blowout preventer. With the cable cut and the coiled tubing blowout preventer installed, the cable unit at the surface is replaced with the coiled tubing unit as shown in Block 204. For example, the wireline truck is replaced with the coil tubing unit. The coiled tubing unit is provided with a coiled tubing that is configured to be inserted into the wellbore. Additionally, the coiled tubing unit includes a wire configured to travel through the coiled tubing. Further, a coiled tubing bottom hole assembly is attached to an end of the coiled tubing. The coiled tubing bottom hole assembly includes at least a wire cutter and a downhole stripper.

In Block 205, with the coiled tubing unit at the surface, the wire traveling through the coiled tubing is connected to the cable. For example, a connection tool at the end of the wire connects to the free end of the cable. The connection tool may be a bolt nut/rope socket configured to handle the tension on the cable. The free end of the cable is the point at which the cable is cut at the surface. Next, the cable valve is now opened as shown in Block 206. For example, blind rams may be opened to retract out of the bore.

In Block 207, with the cable valve open (i.e., the blind ram is opened), the coiled tubing is lowered into the wellbore and simultaneously, the wire pulls the cable through the coiled tubing. For example, a control system on the coiled tubing unit controls a speed at which the coiled tubing is lowered into the wellbore. Additionally, a speed at which the wire pulls the cable is matched to the speed at which the coiled tubing is lowered. A speedometer may transmit a speed of the wire to the control system to match the speed of the coiled tubing. Further, the tension the cable is maintained by a pulling force of the wire. A tension sensor may be used to monitor the tension on the cable. In Block 208, the coiled tubing is continued running in down the wellbore while pulling the cable inside the coiled tubing.

In Block 209, the coiled tubing bottom hole assembly reaches the stall or stuck point in the wellbore. Once the stall or stuck point is reached, the wire cutter of the coiled tubing bottom hole assembly is actuated to cut to the cable at the lowest point of the coiled tubing. By cutting the cable at the lowest point of the coiled tubing, the cable is not left within the wellbore. After the cable is cut, the coiled tubing is pulled out of the wellbore as shown in Block 210. Additionally, once the coiled tubing is out of the wellbore, the coiled tubing bottom hole assembly may be replaced with a different coiled tubing bottom hole assembly for additional fishing operations.

Figure 3:
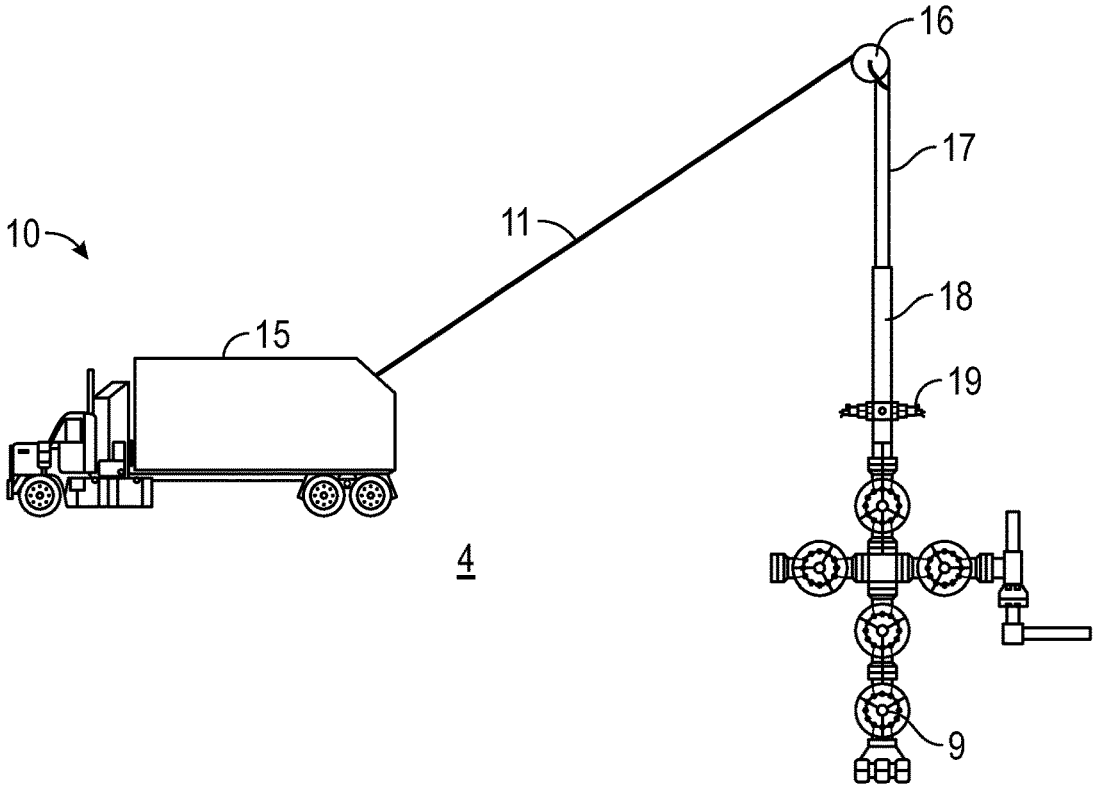
FIGS. 3-9 show examples of a fishing operation at the well system of FIG. 1, implementing the method of FIG. 2, in accordance with one or more embodiments of the present disclosure.

Now referring FIGS. 3-9, in one or more embodiments, FIGS. 3-9 illustrates a system of implementing the method described in the flowchart of FIG. 2 at the wellsite 1 of FIG. 1. In FIG. 3, in one or more embodiments, a close-up view of the surface 4 of FIG. 1 is illustrated. The cable 11 is employed from the cable unit 10 into the wellhead 9. The cable unit 10 may be a truck 15 or trailer having a drum to spool and unspool the wireline and/or slickline. To insert the cable 11 in the wellhead 9, the cable 11 must be vertically upright. To achieve a vertical upright position, the cable 11 is run through a sheave 16 axially above the wellhead 9. The sheave 16 receives the cable 11 at an angle and rotates the cable to be vertical upright. From the sheave 16, the cable 11 may enter a pressure control device 17 such as a stuffing box to contain well pressure while the cable 11 is either moving or stationary, while also being a guide for the cable 11. From the pressure control device 17, the cable may enter a lubricator 18. The lubricator 18 is a long, high-pressure pipe fitted to the top of the wellhead 9 so that tools may be put into a high-pressure well. The lubricator 18 may include a high-pressure grease-injection section and sealing elements. As tools are placed in the lubricator 18, the lubricator 18 is pressurized to wellbore pressure. Then the top valves of the wellhead 9 are opened to enable the tools to fall or be pumped into the wellbore 9 under pressure. From the lubricator 18, the cable enters a cable valve 19 on top of the wellhead 9. The cable valve 19 may be a wireline blind ram of a blowout preventer to close and seal around the cable 11 which allows operations to be performed under pressure, on surface equipment, when the cable 11 is still in the wellbore 2.

To initiate the fishing operation, the wellhead 9 shuts off the wellbore 3. After shutting off the wellbore, the cable valve 19 is actuated to close and seal around the cable 11. For example, blind rams of the cable valve 19 may be actuated to extend and close around the cable 11. With the wellbore 3 shut off and the cable 11 sealed within the cable valve 19, the fishing operation proceeds to the next step as shown in FIG. 4.

Figure 4:
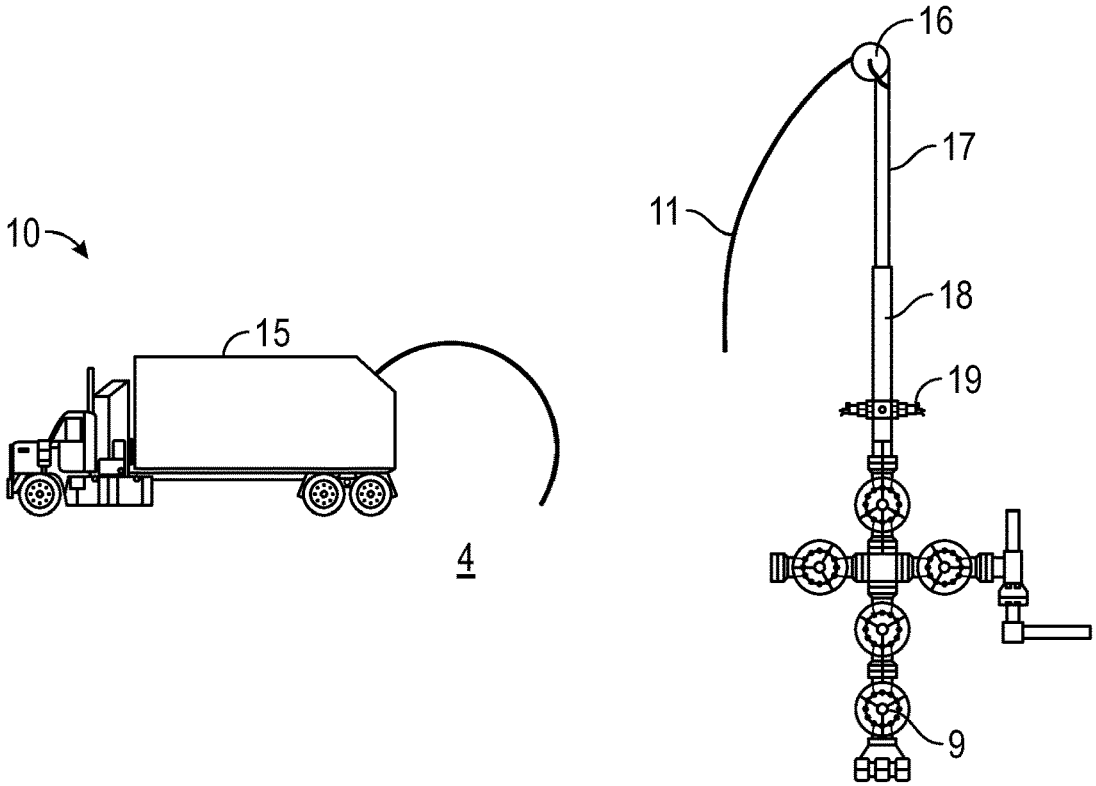

In FIG. 4, a portion of the cable 11 is rolled out from the sheave 16 at the surface 4 and cut from the truck 15 of the cable unit 10. For example, a cutting tool may be operated at the surface 4 to cut the cable 11 to form a free cut end 20. Additionally, with the cable 11 cut from the cable unit 10, the cable valve 19 will temporarily hold the cable 11 in tension without dropping in the cable 11 into the wellbore. For example, blind rams of the cable valve 19 close on the cable 11 and isolate the wellbore without cutting the cable 11. With the cable 11 cut at the surface 4, the fishing operation proceeds to the next step as shown in FIG. 5.

Figure 5:
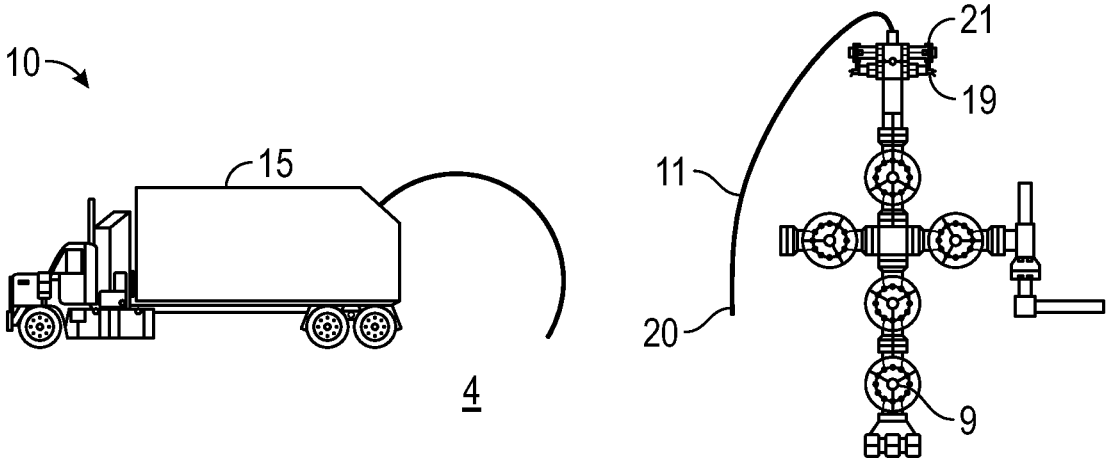

Now referring to FIG. 5, the sheave 16, the pressure control device 17, and the lubricator 18 are removed off the wellhead 9. From the free cut end 20 of the cable 11 coming out of the wellhead 9, a coiled tubing blowout preventer (BOP) 21 is rigged on top of the cable valve 19. To ensure proper safety measurements are meet, the wellbore 2 should be properly shut off prior to starting the rig up of the coiled tubing BOP 21 and the cable valve 19 should be activated to ensure two barriers are provided. With the coiled tubing BOP 21 in place, the fishing operation proceeds to the next step as shown in FIG. 6.

Figure 6:
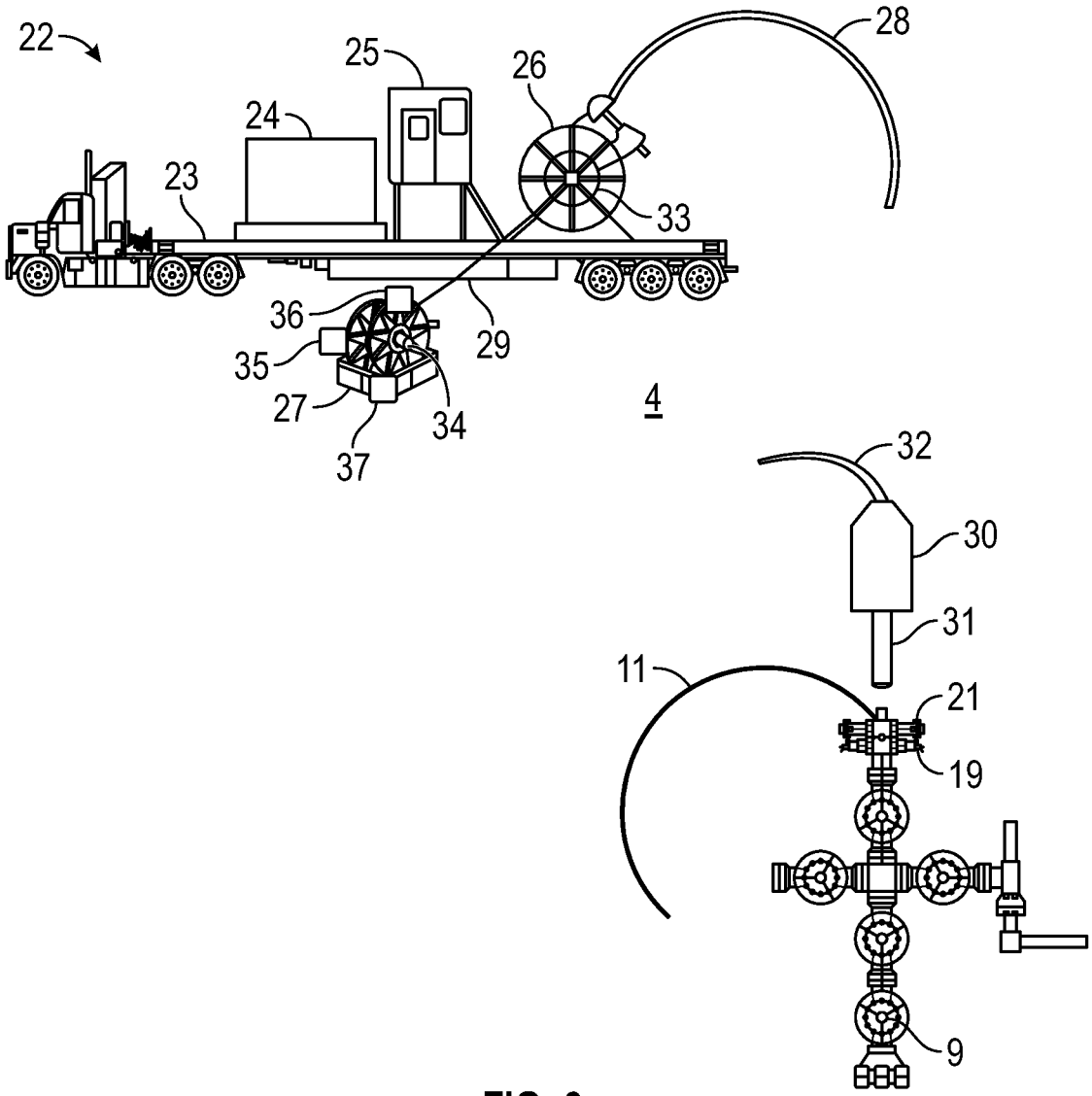

Now referring to FIG. 6, in one or more embodiments, with the coiled tubing BOP 21 above the wellhead 9, a coiled tubing unit 22 replaces the cable unit (see 10 in Figures in 3-5). The coiled tubing unit 22 may include a trailer 23 to transport and store the coiled tubing equipment. For example, a control center 24, a power system 25, and a coiled tubing spool reel 26 are disposed on the trailer 23. The coiled tubing spool reel 26 is configured to roll out a coiled tubing 28 wrapped around a drum 33 of the coiled tubing spool reel 26. Additionally, an additional wire spool reel 27 is provided adjacent to the coiled tubing spool reel 26. The wire spool reel 27 is configured to roll out a wire 29 wrapped around a drum 34 of the wire spool reel 27. The control center 24 may send commands to the power system 25 to power the coiled tubing spool reel 26 and the wire spool reel 27.

In some embodiments, the wire 29 exits the wire spool reel 27 and is inserted into an end of the coiled tubing 28 to exit a distal end of the coiled tubing 28 approximate the cable 11. Specifically, while the wire 29 exits the coil drum 33 and is rolled in the reel 34 while running in hole, the other end of the wire exits the coil through the BHA and connected to the stuck wire (after cutting). Additionally, the wire spool reel 27 may include a speedometer 35 and a tension sensor 36. The speedometer 35 measures a rate at which the wire 29 spools or unspools on the drum 34. The control center 24 may then receive transmitted data from the speedometer 35 to control a speed of the wire spool reel 27 to match the speed of the coiled tubing spool reel 26 when spooling and unspooling. The tension sensor 36 measures a tension force on the wire 29. In addition, the wire spool reel 27 may include a port 37 to pump friction reducers, such as grease, inside the wire spool reel 27 to ease pulling the wire 29 and eliminate any high tension on the wire 29 when traveling through the coiled tubing 28.

Still referring to FIG. 6, in one or more embodiments, an injector head 30 is held above the coiled tubing BOP 21. The injector head 30 incorporates special profiled chain assemblies to grip the coiled tubing 28 and a hydraulic drive system that provides the tractive effort for running and retrieving the coiled tubing 28 from the wellbore (see 2 in FIG. 1). Additionally, a base of the injector head 30 is secured to the coiled tubing BOP 21 by a coiled tubing stripper pipe 31. The coiled tubing stripper pipe 31 is designed to seal around the coiled tubing 28 as it is stripped in and out of the wellbore. The coiled tubing stripper pipe 31 may further allow the discharge of the cable 11 inside the coiled tubing 28 while displacing the wire 29. Further, a gooseneck 32 or guided arc is mounted on top of the injector head 30 and feeds the coiled tubing 28 from the coiled tubing spool reel 26 around a controlled radius into the injector head 30. The gooseneck 32 guides the coiled tubing 28 as it passes through an arc from the coiled tubing spool reel 26 into a vertical alignment with the injector head 30 and the wellbore.

Figure 7:
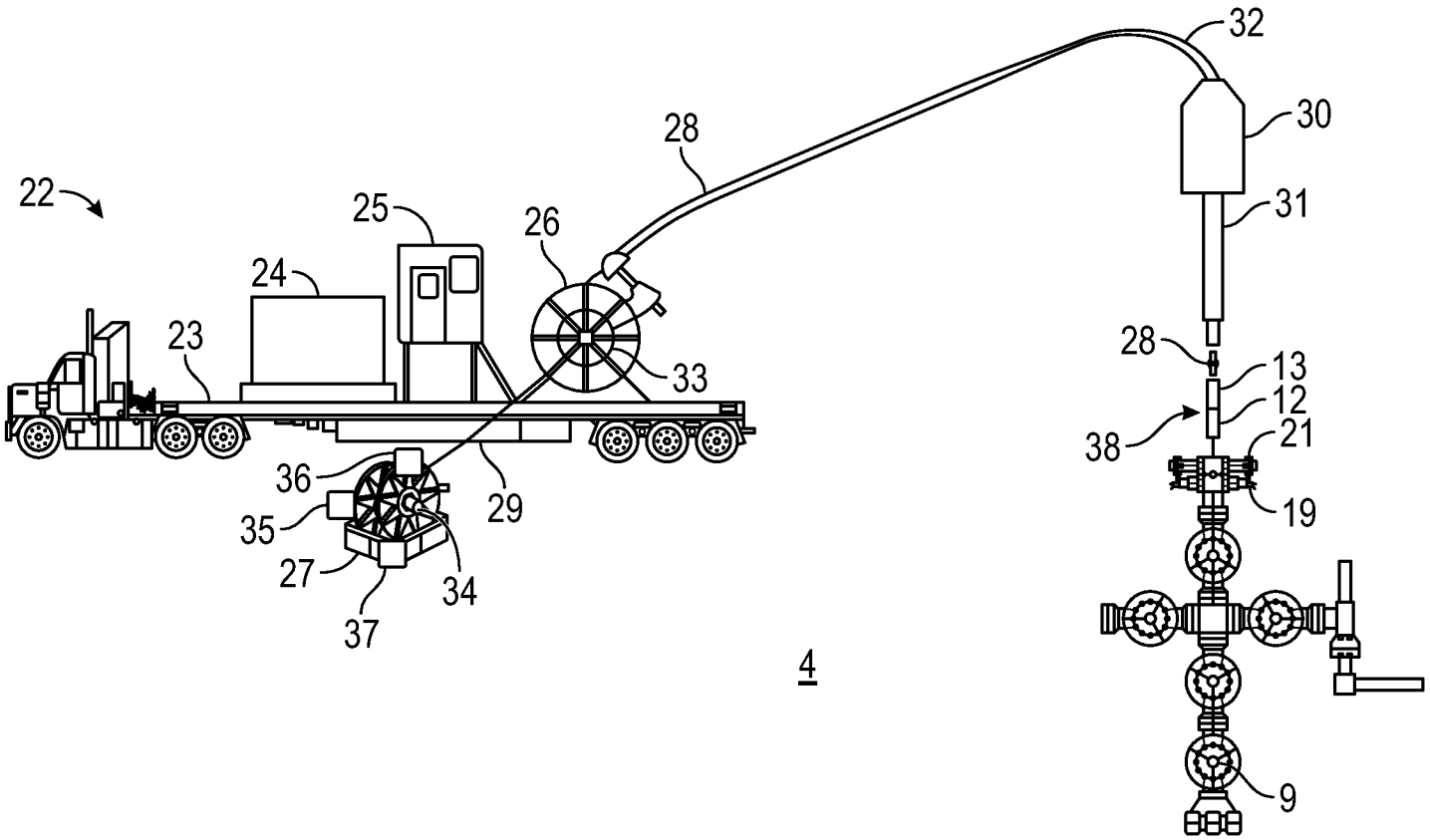
Figure 8:
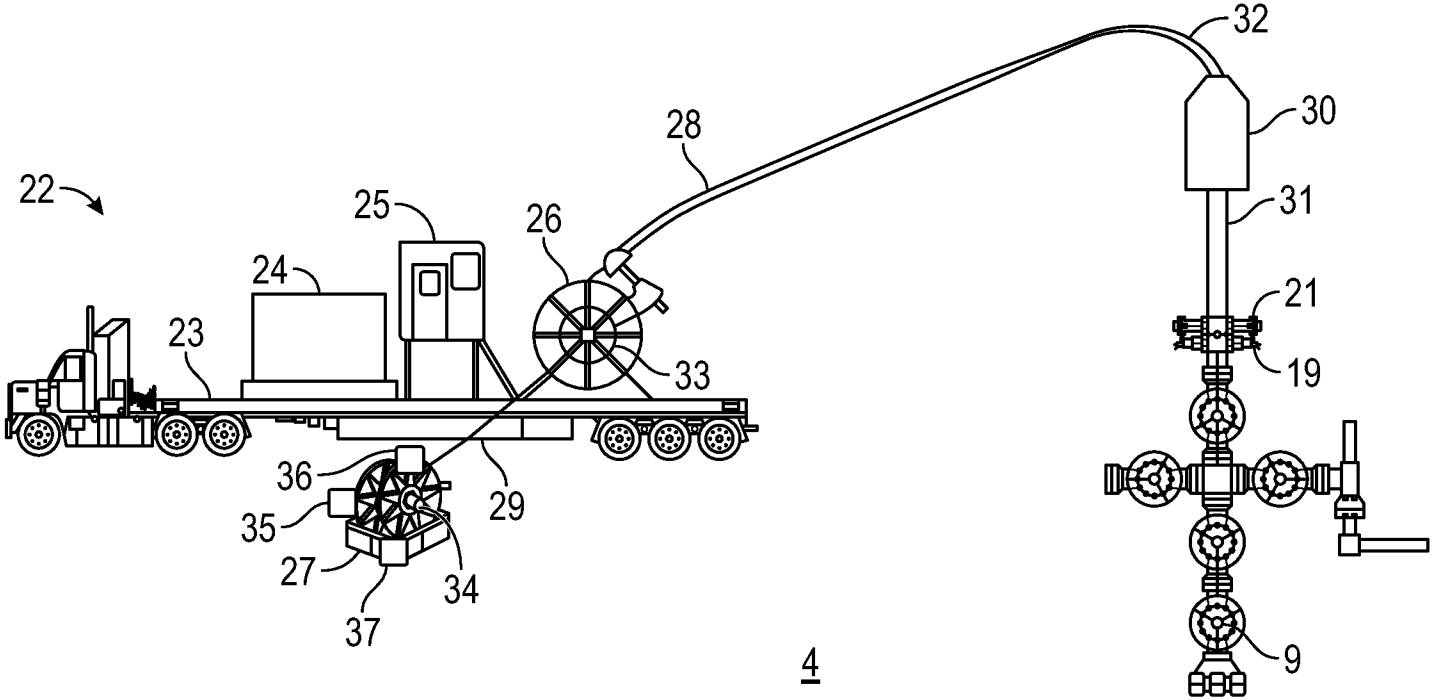
Figure 9:
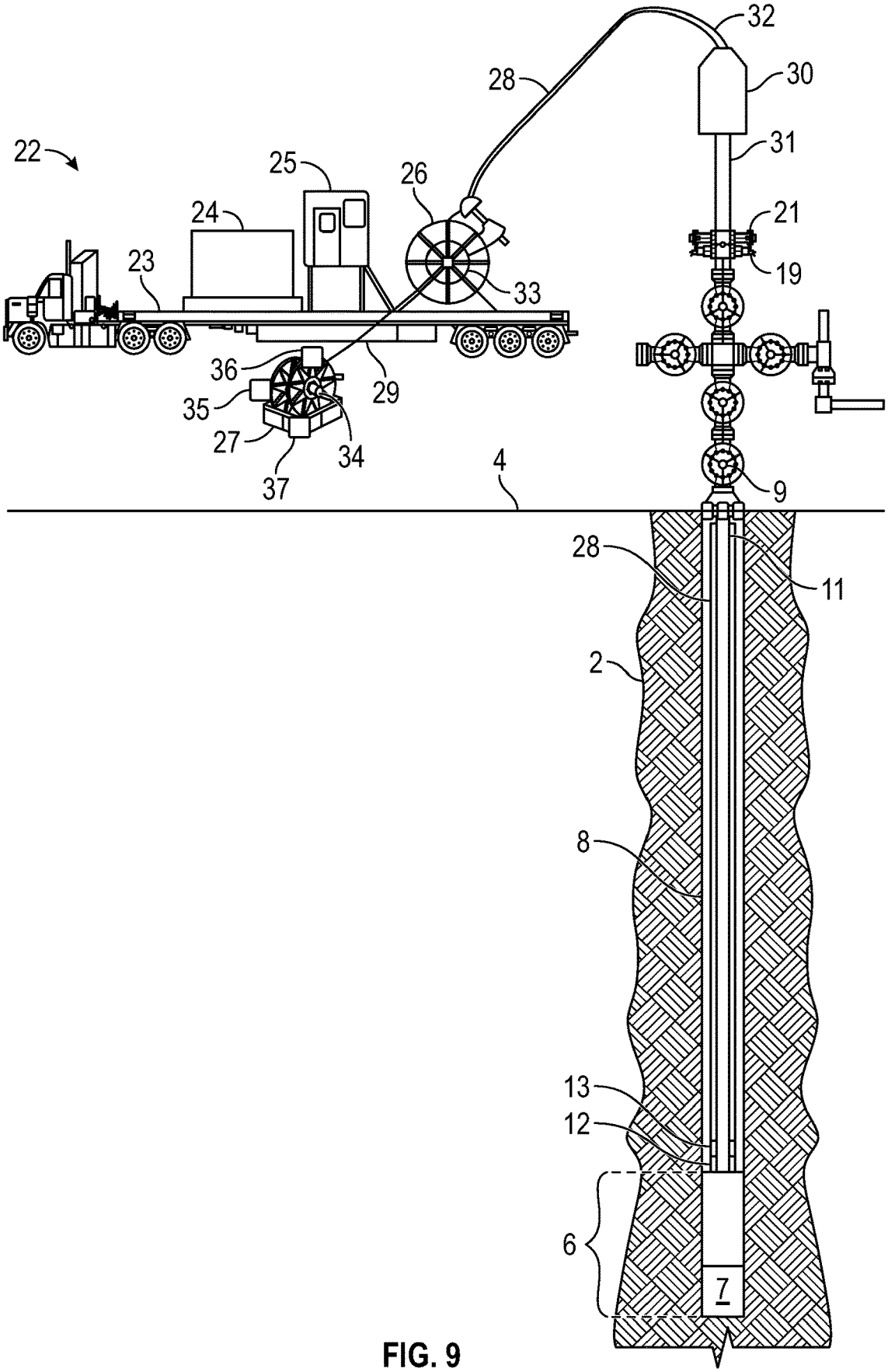

Now referring in FIG. 7, with the injector head 30 still held above the coiled tubing BOP 21, the coiled tubing 28 is unspooled and run through the gooseneck 32 to enter the injector head 30 and exit via the coiled tubing stripper pipe 31. Additionally, the wire 29 is unspooled and run through the coiled tubing 28 to exit below the injector head 30. At an end of the wire 29 is a connection tool (see FIGS. 12 and 13) to connect the wire 29 to the free cut end of the wireline (see 11 in FIGS. 3-5). The connection tool may be a bolt and nut tool or rope socket tool to support the tensions from the wire 29 and the cable.

In one or more embodiments, a coiled tubing bottom hole assembly (BHA) 38 is attached to the coiled tubing 28 before entering the wellhead 9. The coiled tubing BHA 38 includes at least a wire cutter 12 and a downhole stripper 13. The wire cutter 12 is used to cut the cable within the wellbore. The downhole stripper 13 seals around the coiled tubing 28 to keep fluids out of the coiled tubing 28. The wire cutter 12 may be positioned below the downhole stripper 13. In some embodiments, the wire cutter 12 may be battery operated.

With the wire 29 connected to the cable and the coiled tubing BHA 38 attached to the coiled tubing 28, the injector head 30 is landed on the coiled tubing BOP 21 as shown in FIG. 7. Next, the coiled tubing BOP 21 and the cable valve 19 are open to allow the coiled tubing 28 to be enter the wellhead 9. From the wellhead 9, the coiled tubing 28 is run in hole to a depth of the stalled or stuck tool. For example, the coiled tubing 28 extends downward in the wellbore 2 through a conduit of the tubular string 8 to the stalled or stuck tool. As the coiled tubing 28 is unspooled off the coiled tubing spool reel 26, the wire 29 is spooled onto the wire spool reel 27 at a same rate to replace the wire 29 inside the coiled tubing 28 with cable 11. The wire 29 pulls on the cable 11 based on the speed of the coiled tubing 28. Once the coiled tubing 28 reaches the stall or stuck point, the wire cutter 12 is activated to cut the cable 11 at a downward most position of the coiled tubing BHA 38. It is further envisioned that the wire cutter 12 includes a sensor to avoid being actuated before reaching the depth of the stall or stuck point. For example, the sensor may be a positional sensor with the depth of the stall or stuck point programmed to ensure that the wire cutter 12 does not cut the cable 11 before the wire cutter 12 reaches that the depth of the stall or stuck point. With the cable 11 cut, the coiled tubing 28 may be pull out of the wellbore 2. Once out of the wellbore 2, the coiled tubing BHA 38 may be switched, and further fishing operations may be conducted without leaving any of the cable 11 in the wellbore 2.

Figure 10:
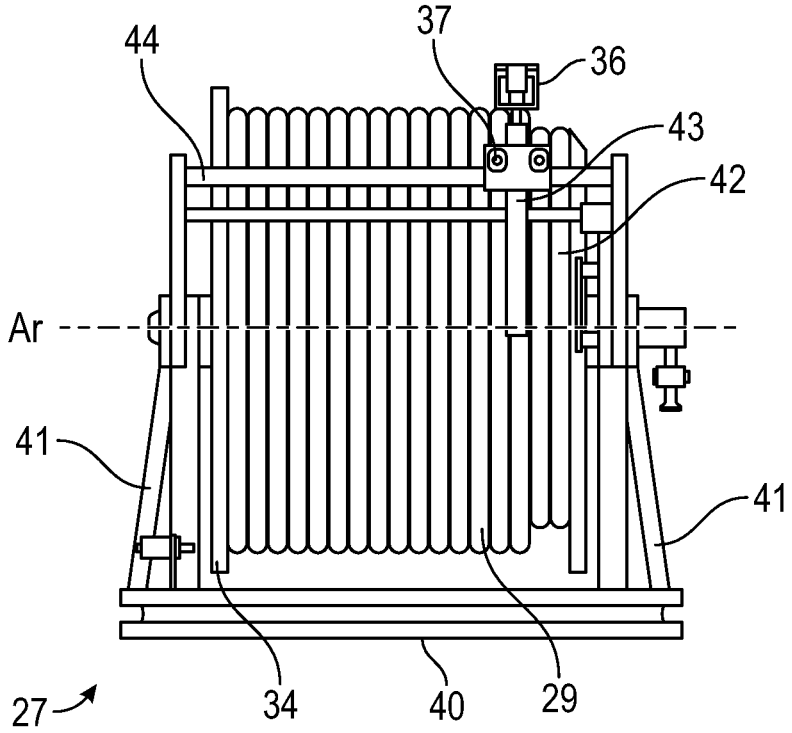
FIG. 10 shows an example of a wire spool reel of FIGS. 6-9 in accordance with one or more embodiments of the present disclosure.

Now referring to FIG. 10, in one or more embodiments, a perspective view of the additional wire spool reel 27 is illustrated. The additional wire spool reel 27 may include a base 40 with a plurality of support beams 41 extending upward. The drum 34 may be rotationally coupled to the plurality of support beams 41 to rotate about an axis Ar that is parallel to the base 40.

In one or more embodiments, a depth encoder 42 may be operationally coupled to the drum 34 at the axis Ar. The speedometer (see 35) may be incorporated into the depth encoder 42 that measures a depth and time of the wire 29 to determine a speed of the wire 29. For example, the depth encoder 42 measures every rotation of the drum 34, a circumference of the drum 34, and a thickness of the wire 29 to determine the depth at which the wire 29 is deployed into the wellbore.

In one or more embodiments, the tension sensor 36 may be coupled to a wire guide 43. The wire guide 43 may be movable attached to rods 44 to slidably move side-to-side of drum 34 as the wire 29 spools or unspools. In addition, the port 37 may be disposed on the wire guide 43 to pump friction reducers, such as grease, inside the wire spool reel 27 to ease pulling the wire 29 and eliminate any high tension on the wire 29 when traveling through the coiled tubing (see 28).

Figure 11:
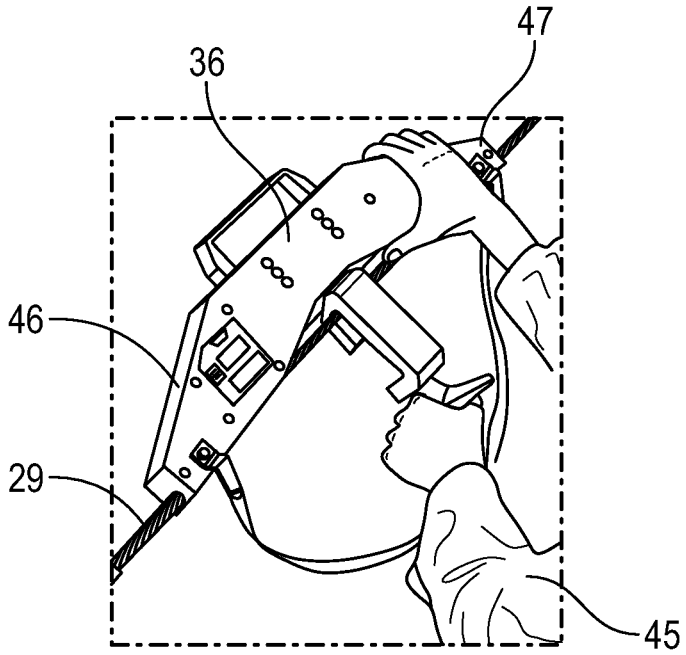
FIG. 11 shows an example of a tension sensor in accordance with one or more embodiments of the present disclosure.

Now referring to FIG. 11, another example of the tension sensor 36 is illustrated. The tension sensor 36 may be directly disposed on the wire 29 by a worker 45 on site. The tension sensor 36 measures the tension the wire 29 between a first end 46 of the tension sensor 36 and a second end 47 of the tension sensor 36.

Figure 12:
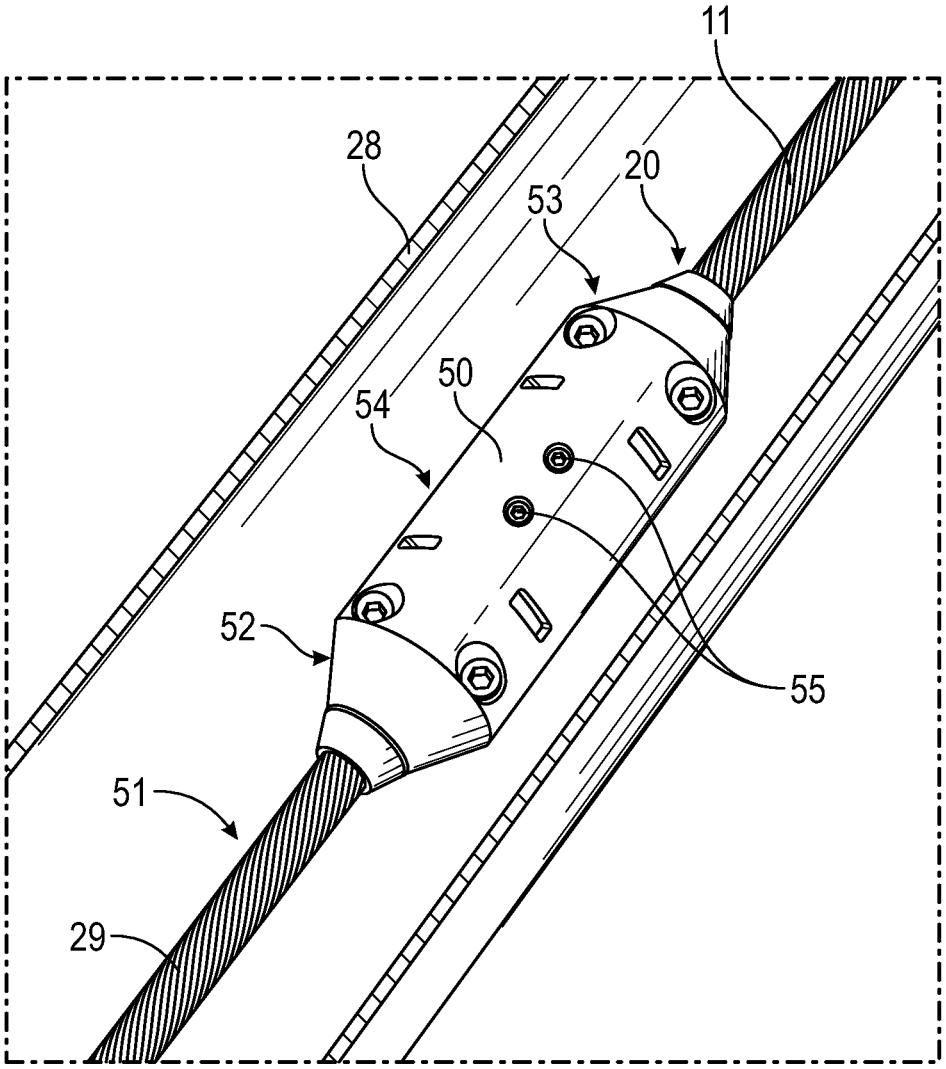
FIGS. 12 and 13 show a perspective view of a connection tool in accordance with one or more embodiments of the present disclosure.

Now referring to FIG. 12, in one or more embodiments, a connection tool 50 to connect the wire 29 to the wireline 11 is illustrated. The connection tool 50. The connection tool 50 may be a rope socket tool. For example, inside the coiled tubing 28, an end 51 of the wire 29 is inserted into a first end 52 of the connection tool 50 and the free cut end 20 of the wireline 11 is inserted into a second end 53 of the connection tool 50. Additionally, a middle portion 54 of the connection tool 50 includes one or more screws or bolts 55 to removable fix the end 51 of the wire 29 and the free cut end 20 of the wireline 11 within the connection tool 50. Further, the first end 52 and the second end 53 may be tapered from the middle portion 54 to aid in further sealing the end 51 of the wire 29 and the free cut end 20 of the wireline 11 within the connection tool 50.

Figure 13:
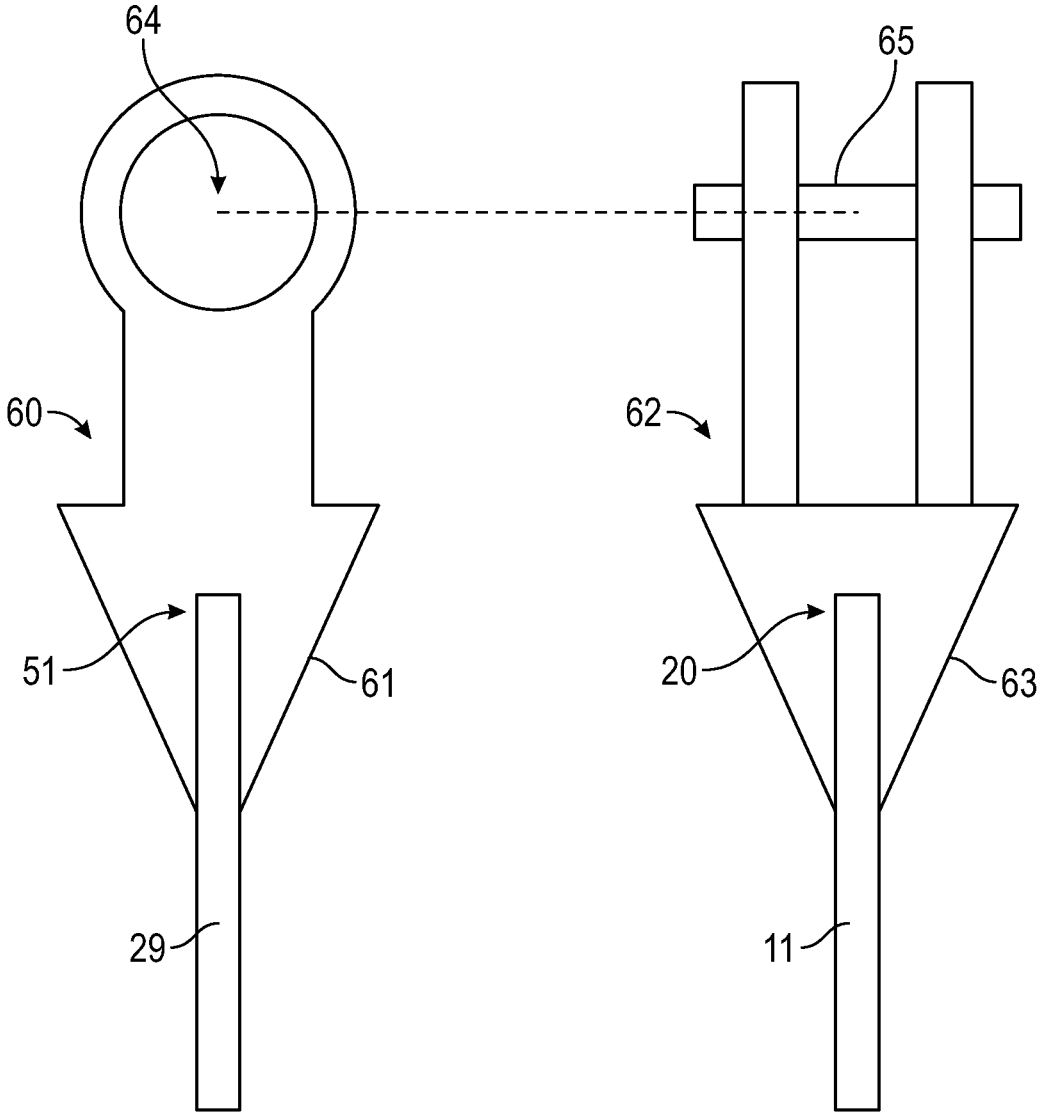

Referring now to FIG. 13, a second embodiment of the connection tool 50 according to embodiments herein is illustrated, where like numerals represent like parts. The second embodiment of FIG. 13 is similar to that of the embodiment of FIG. 12. However, in the second embodiment, the connection tool 50 is a bolt and nut tool instead of a rope socket tool. For example, the end 51 of the wire 29 is inserted into an end 61 of a nut 60 and the free cut end 20 of the wireline 11 is inserted into an end 63 of a bolt 62. An opening 64 distal to the end 61 of the nut 60 receives (see dotted line) a bolt connection 65 of the bolt 62 to couple the wire 29 to the wireline 11.

Fishing operations, according to embodiments herein, is a method and system to utilize a coiled tubing to retrieve a cable within a wellbore. A wire may be inserted into coiled tubing to connect to the cable and apply tension to the cable as the coiled tubing is lower into the wellbore. Further, a coiled tubing bottom hole assembly (BHA) may be attached to a distal end of the coiled tubing. The coiled tubing BHA includes a wire cutter at a lower most end to cut the cable without leaving any components in the wellbore as the wire is holding the cable in tension. By cutting cable at lower most end, the fishing operations according to embodiments herein eliminate the need for further fishing operations and can return the well to service faster to significantly improve the operational safety, reliability, and longevity during drilling and work-over operations. Overall the fishing operations using the coiled tubing with a wire and coiled tubing BHA may minimize product engineering, risk associated with downhole power sources, reduction of assembly time, hardware cost reduction, and weight and envelope reduction.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A method for conducting a fishing operation on a wellbore having a tubular string therein with a wireline extending into the wellbore from a wellhead, the method comprising:

actuating a blind ram above the wellhead to seal around the wireline;

pulling out a portion of the wireline out of the wellhead;

cutting the portion of the wireline;

rigging up a coiled tubing blowout preventer on top of the blind ram;

connecting a wire within a coiled tubing to the wireline;

connecting a coiled tubing bottom hole assembly to the coiled tubing;

opening the blind ram and running in hole the coiled tubing into the wellbore;

pulling, with the wire, the wireline inside the coiled tubing as the coiled tubing is lowered into the wellbore;

lowering the coiled tubing to reach a depth within the wellbore containing a stall or stuck point in the tubular string;

cutting the wireline with a wire cutter of the coiled tubing bottom hole assembly; and pulling out the coiled tubing with the wireline.

2. The method of claim 1, further comprising:

unspooling the coiled tubing from a coiled tubing spool reel at a first speed;

spooling the wire onto a wire spool reel at a second speed; and replacing the wire within the coiled tubing with the wireline, wherein the first speed equals the second speed.

3. The method of claim 1, further comprising sealing around the coiled tubing with a downhole stripper of the coiled tubing bottom hole assembly to keep fluids out of the coiled tubing.

4. The method of claim 1, further comprising inserting the wire at an end of the coiled tubing opposite to an end of the coiled tubing bottom hole assembly.

5. The method of claim 1, further comprising providing tension to the wireline with the wire.

6. The method of claim 1, further comprising replacing a wireline unit at a surface of the wellbore with a coiled tubing unit.

7. The method of claim 1, further comprising replacing a wireline unit at a surface of the wellbore with a coiled tubing unit.

8. The method of claim 1, further comprising landing an injector head on the coiled tubing blowout preventer.

9. A system, comprising:

a wellhead on a surface of a wellbore;

a tubing string disposed within the wellbore;

a wireline extending downward into the wellbore from the wellhead;

a wireline blind ram disposed on top of the wellhead;

a coiled tubing blowout preventer disposed on top of the wireline blind ram;

a modified coiled tubing spooled on the surface, the modified coiled tubing comprises:

a coiled tubing spooled on a first spool reel;

a wire spooled on a second spool reel, wherein the wire is inserted in one end of the coiled tubing; and a coiled tubing bottom hole assembly connected to an opposite end of the coiled tubing, wherein coiled tubing bottom hole assembly comprises a wire cutter configured to the cut the wireline and a downhole stripper configured to seal around the coiled tubing, wherein the wire is connected to the wireline and configured to pull the wireline when the coiled tubing is run in the wellbore.

10. The system of claim 9, further comprising an injector head disposed on top of the coiled tubing blowout preventer.

11. The system of claim 10, wherein a base of the injector head is secured to the coiled tubing blowout preventer by a coiled tubing stripper pipe.

12. The system of claim 10, further comprising a gooseneck mounted on top of the injector head and feeds the coiled tubing from the first reel into the injector head.

13. The system of claim 12, wherein the gooseneck guides the coiled tubing through an arc from the first reel into a vertical alignment with the injector head and the wellbore.

14. The system of claim 9, wherein the wire cutter is positioned below the downhole stripper.

15. The system of claim 9, further comprising a bolt nut or rope socket tool to connect to the wire to the wireline.

16. A method for conducting a fishing operation on a wellbore having a tubular string therein with a wireline extending into the wellbore from a wellhead, the method comprising:

shutting off the wellbore from further downhole operations;

actuating a wireline blind ram to close and seal around the wireline;

rolling out a portion of the wireline out of the wellhead;

cutting the portion of the wireline at a surface;

rigging up a coiled tubing blowout preventer on top of the wireline blind ram;

replacing a wireline unit at the surface with a coiled tubing unit;

connecting a wire of the coiled tubing unit to the wireline, wherein the wire travels through a coiled tubing of the coiled tubing unit;

retracting a blind ram and of the wireline blind ram and running in hole the coiled tubing into the wellbore;

pulling, with the wire, the wireline inside the coiled tubing as the coiled tubing is lowered into the wellbore;

lowering the coiled tubing to reach a depth within the wellbore containing a stall or stuck point in the tubular string;

actuating a wire cutter of a coiled tubing bottom hole assembly attached to a lowermost end of the coiled tubing; and pulling out the coiled tubing with the wireline out of the wellbore.

17. The method of claim 16, further comprising pulling the wireline at a speed matching a rate at which the coiled tubing is lowered.

18. The method of claim 16, further comprising maintaining a tension on wireline with a pulling force of the wire.

19. The method of claim 16, wherein connecting the wire of the coiled tubing unit to the wireline comprises attaching a connection tool at an end of the wire to a free end of the wireline.

20. The method of claim 16, further comprising replacing the coiled tubing bottom hole assembly with a different coiled tubing bottom hole assembly for additional fishing operations.

* * * * *